US011155891B2

(12) United States Patent
Hiraoka et al.

(10) Patent No.: US 11,155,891 B2
(45) Date of Patent: Oct. 26, 2021

(54) SURFACE HARDENING TREATMENT DEVICE AND SURFACE HARDENING TREATMENT METHOD

(71) Applicant: PARKER NETSUSHORI KOGYO CO., LTD., Tokyo (JP)

(72) Inventors: Yasushi Hiraoka, Tokyo (JP); Youichi Watanabe, Tokyo (JP)

(73) Assignee: PARKER NETSUSHORI KOGYO CO., LTD., Tokyo (JP)

( * ) Notice: Subject to any disclaimer, the term of this patent is extended or adjusted under 35 U.S.C. 154(b) by 157 days.

(21) Appl. No.: 16/628,724

(22) PCT Filed: Jul. 6, 2018

(86) PCT No.: PCT/JP2018/025683
§ 371 (c)(1),
(2) Date: Jan. 6, 2020

(87) PCT Pub. No.: WO2019/009408
PCT Pub. Date: Jan. 10, 2019

(65) Prior Publication Data

US 2020/0190609 A1 Jun. 18, 2020

(30) Foreign Application Priority Data

Jul. 7, 2017 (JP) ..... JP2017-133910
Jul. 20, 2017 (JP) ..... JP2017-140503

(51) Int. Cl.
*C21D 1/06* (2006.01)
*C23C 8/26* (2006.01)

(52) U.S. Cl.
CPC . *C21D 1/06* (2013.01); *C23C 8/26* (2013.01)

(58) Field of Classification Search
CPC ..... C21D 1/06; C23C 8/26
See application file for complete search history.

(56) References Cited

U.S. PATENT DOCUMENTS

| | | | | |
|---|---|---|---|---|
| 2017/0138326 | A1 | 5/2017 | Paulus et al. | F02M 61/168 |
| 2017/0292172 | A1 | 10/2017 | Korwin et al. | |
| 2018/0245195 | A1 | 8/2018 | Umehara et al. | C23C 8/26 |

FOREIGN PATENT DOCUMENTS

| | | | | |
|---|---|---|---|---|
| CN | 104480424 | A | 4/2015 | |
| CN | 106852159 | A | 6/2017 | |
| JP | 63-199859 | A | 8/1988 | C23C 8/22 |
| JP | 2003005802 | A | 1/2003 | G05B 11/36 |
| JP | 5167553 | | 3/2013 | C23C 8/26 |
| JP | 2015-175009 | A | 10/2015 | C23C 8/32 |
| JP | 2016211069 | A | 12/2016 | C21D 1/06 |
| JP | 2017066490 | A | 4/2017 | C21D 1/06 |
| JP | 2017-82275 | A | 5/2017 | C23C 8/26 |
| WO | WO 2004/044248 | A1 | 5/2004 | C21B 7/24 |
| WO | WO 2016/054722 | A1 | 4/2016 | C21D 6/00 |

OTHER PUBLICATIONS

Hiraoka; *Atmosphere-control type of gas nitriding/soft nitriding*; Parker Netsushori Kogyo Co., Ltd.; 13th Surface Refining Technical Research Meeting; Oct. 9, 2015; pp. 1-17 Concise explanation: discloses a gas nitriding treatment in which NH3 gas and AX gas are used and a nitriding potential is calculated.

Mechanical Surface Tech; *The 13th surface refining technical research meeting was held by Parker Netsushori Kogyo Co., Ltd. or the like*; Oct. 15, 2015 (https://surface.mechanical-tech.jp/node/1853) Concise explanation: discloses a gas nitriding treatment in which a nitriding potential is calculated.

Hiraoka; *Characteristic and application of atmosphere-control type of gas nitriding*; Chubu Branch of The Japan Society For Heat Treatment; Oct. 6, 2016; pp. 1-9 Concise explanation: discloses a gas nitriding treatment in which a nitriding potential is calculated.

Hiroi; *2nd Edition of Foundation and Application of a Digital Instrumentation Control System*; Kogyogijutsusha, Oct. 1, 1990; pp. 118-123, and 156-159 Concise explanation: discloses an auto-tuning function for a PID control method.

Tanaka et al.; *Development of an automatic controller with an anti-hunting function*; Yokogawa Technical Report; vol. 45, No. 2; Yokogawa Electric Corporation; 2001; pp. 127-130 Concise explanation: discloses an auto-tuning function for a PID control method.

Mishima et al.; *the fully revised version 6 of Guidance of heat treatment technique*: The Japan Society For Heat Treatment and The Japan metal Heat Treatment Association; Aug. 12, 2014; pp. 66-71 Concise explanation: discloses an auto-tuning function for a PID control method.

Japan Industrail Furnace Manufacturers Association; *The new edition of Industrial furnace handbook*; Nov. 28, 1997, pp. 632-637 Concise explanation: discloses an auto-tuning function for a PIP control method.

Hibino; *The Heisei 21* (2009) *new-employee training meeting text*; Japan Industrial Furnace Manufacturers Association; 2009; p. 42 Concise explanation: discussed in specification as filed at p. 2, paragraph 0007.

Hiraoka et al.; *Phase Control of Compound Layer for Gas Nitrided Low Alloy Steel by Using Nitriding Potential Control and Thermodynamic Calculation Methods*; Heat Treatment, vol. 55, No. 1; pp. 7-11; Feb. 28, 2015 Concise explanation: discussed in specification filed at top of p. 3 (continuation of paragraph 0007 from p. 2).

Liedtke et al.; *The 2nd Edition of Nitriding and Nitrocarburizing on Iron Materials*; Agune Technical Center; 2013; pp. 158-163 Concise explanation: discloses a method of controlling the total amount while keeping the flow rate ratio between the respective furnace introduction gasses constant.

(Continued)

*Primary Examiner* — Jessee R Roe
(74) *Attorney, Agent, or Firm* — Renner Kenner Greive Bobak Taylor and Weber; Tama L. Drensk

(57) ABSTRACT

Based on the nitriding potential in the processing furnace calculated by the in-furnace nitriding potential calculator and a target nitriding potential, an introduction amount of each of the plurality of furnace introduction gases is controlled by changing a flow rate ratio between the plurality of furnace introduction gases while keeping a total introduction amount of the plurality of furnace introduction gases constant, such that the nitriding potential in the processing furnace is brought close to the target nitriding potential.

8 Claims, 7 Drawing Sheets

(56) References Cited

OTHER PUBLICATIONS

Hiraoka et al.; *Effect of Compound Layer Thickness Composed of* $\gamma'$-$Fe_4N$ *on Rotated-Bending Fatigue Strength in Gas-Nitrided JIS-SCM435 Steel*; Materials Transactions; vol. 58, No. 7; 2017; pp. 993-999.

Office Action dated Oct. 4, 2017 in related application No. JP 2017-140503.

Office Action dated Feb. 23, 2018 in related application No. JP2017-140503.

International Search Report dated Sep. 11, 2018 in related application No. PCT/JP2018/025683.

Written Opinion dated Sep. 11, 2018 in related application No. PCT/JP2018/025683.

Opposition documents (original and machine translation) as filed in related Japanese patent No. JP6345320 Dec. 14, 2018.

Office Action from the Korean Patent Office dated Jun. 15, 2021 for Korean Patent Application No. 10-2020-7002725 and machine translation into English.

The PID Gains Autotuning Program Method of DC Servo Motor Speed Controller by The Iterative Learning Control, Lee Eun-Oh; Dankook University Graduate Thesis, Jun. 8, 2000, English abstract included.

Braziunas et al.; *Automated Measurement System for Gas Nitriding/Nitrocarburizing*; Industrial Heating; National Industrial Publishing Co.; vol. 72, No. Jan; Jan. 1, 2005; pp. 34-39.

EP SR dated Dec. 17, 2020 in related application No. 18828066.3.

Office Action from the Chinese Patent Office dated May 24, 2021 for Chinese Patent Application No. 201880044779.3 and the machine translation in English from Espacenet.

FIG.2

| | | Set Nitriding Potential | Set PID | Controlled Range | Error (Maximum) | Total Gas Flow Amount (l/min) | Structure of Surface Phase |
|---|---|---|---|---|---|---|---|
| Treatment ① | Example | 2 | P=9, I=110, D=28 | 1.3 ~ 1.44 | 35% | 150 (constant) | ε phase |
| | Comparative Example | | P=6.5, I=130, D=35 | — | — | Forcibly stopped because capability of exhaust gas combustion decomposition apparatus (200 l/min) was exceeded | ε phase |
| Treatment ② | Example | 1.5 | P=7.4, I=116, D=29 | 1.3 ~ 1.44 | 13% | 150 (constant) | ε phase |
| | Comparative Example | | P=6.5, I=130, D=35 | 1.38 ~ 1.58 | 8% | 189 ~ 198 | ε phase |
| Treatment ③ | Example | 1.3 | P=7.0, I=118, D=29 | 1.25 ~ 1.3 | 4% | 150 (constant) | ε phase |
| | Comparative Example | | P=6.5, I=130, D=35 | 1.22 ~ 1.38 | 6% | 162 ~ 175 | ε phase |
| Treatment ④ | Example | 1 | P=6.1, I=122, D=30 | 0.98 ~ 1.02 | 2% | 150 (constant) | ε + γ' phase |
| | Comparative Example | | P=6.5, I=130, D=35 | 1 ~ 1.01 | 1% | 127 ~ 131 | ε + γ' phase |
| Treatment ⑤ | Example | 0.8 | P=5.6, I=125, D=31 | 0.78 ~ 0.81 | 3% | 150 (constant) | ε + γ' phase |
| | Comparative Example | | P=6.5, I=130, D=35 | 0.76 ~ 0.84 | 5% | 98 ~ 110 | ε + γ' phase |
| Treatment ⑥ | Example | 0.6 | P=4.9, I=135, D=34 | 0.59 ~ 0.61 | 2% | 150 (constant) | ε + γ' phase |
| | Comparative Example | | P=6.5, I=130, D=35 | 0.56 ~ 0.63 | 7% | 70 ~ 87 | ε + γ' phase |
| Treatment ⑦ | Example | 0.4 | P=4.3, I=152, D=38 | 0.4 ~ 0.41 | 3% | 150 (constant) | ε + γ' phase |
| | Comparative Example | | P=6.5, I=130, D=35 | — | — | Forcibly stopped because of negative pressure in furnace | — |
| Treatment ⑧ | Example | 0.3 | P=3.9, I=164, D=41 | 0.3 | 0% | 150 (constant) | γ' phase |
| | Comparative Example | | P=6.5, I=130, D=35 | — | — | Forcibly stopped because of negative pressure in furnace | — |
| Treatment ⑨ | Example | 0.2 | P=3.5, I=209, D=52 | 0.2 | 0% | 150 (constant) | γ' phase |
| | Comparative Example | | P=6.5, I=130, D=35 | — | — | Forcibly stopped because of negative pressure in furnace | — |
| Treatment ⑩ | Example | 0.1 | P=2.6, I=303, D=76 | 0.1 | 0% | 150 (constant) | α phase |
| | Comparative Example | | P=6.5, I=130, D=35 | — | — | Forcibly stopped because of negative pressure in furnace | — |

| PT. No. 1 | | 01 | 02 | 03 | 04 |
|---|---|---|---|---|---|
| Elapsed Time | | 20 | 100 | 100 | 20 |
| Step Mode | | Temperature Rising | Temperature Constant | Temperature Constant | Temperature Constant |
| Temperature (℃) | | 580℃ | 580℃ | 580℃ | 580℃ |
| Set Time | | 0 Minutes | 100 Minutes | 100 Minutes | 20 Minutes |
| Kn Value | | 0. 2 | 0. 2 | 1. 5 | 0. 3 |
| PI D( KnC) | P : | 3. 5 | 3. 5 | 7. 4 | 3. 9 |
| | I : | 209 | 209 | 116 | 164 |
| | D : | 52 | 52 | 29 | 41 |
| Gas Electromagnetic Valve | | $NH_3$, AX | $NH_3$, AX | $NH_3$, AX | $NH_3$, AX |
| Control Gas Total Flow Amount (L/min) | | 166 | 166 | 166 | 200 |

FIG.7

| | | Set Nitriding Potential | Set PID | Controlled Range | Error (Maximum) | Total Gas Flow Amount (l/min) | Structure of Surface Phase |
|---|---|---|---|---|---|---|---|
| Treatment ① | Example | 9 | P=49.5, I=151, D=43 | 5.1 ~ 5.3 | 43% | 150 (constant) | ε phase |
| | Comparative Example | | P=21.5, I=129, D=32 | — | — | Forcibly stopped because capability of exhaust gas combustion decomposition apparatus (200 l/min) was exceeded | ε phase |
| Treatment ② | Example | 6 | P=31.5, I=140, D=36 | 5.1 ~ 5.3 | 15% | 150 (constant) | ε phase |
| | Comparative Example | | P=21.5, I=129, D=32 | 5.9 ~ 6.0 | 2% | 170 ~ 187 | ε phase |
| Treatment ③ | Example | 4.5 | P=23.7, I=134, D=34 | 4.47 ~ 4.51 | 1% | 150 (constant) | ε phase |
| | Comparative Example | | P=21.5, I=129, D=32 | 4.5 | 0% | 125 ~ 140 | ε phase |
| Treatment ④ | Example | 3 | P=15.6, I=127, D=32 | 2.99 ~ 3.01 | 0% | 150 (constant) | ε phase |
| | Comparative Example | | P=21.5, I=129, D=32 | 2.7 ~ 3.2 | 10% | 98 ~ 119 | ε phase |
| Treatment ⑤ | Example | 1.5 | P=8.5, I=123, D=31 | 1.5 ~ 1.51 | 1% | 150 (constant) | ε+γ'phase |
| | Comparative Example | | P=21.5, I=129, D=32 | 1.3 ~ 1.6 | 13% | 67 ~ 85 | ε+γ'phase |
| Treatment ⑥ | Example | 1.2 | P=7.1, I=125, D=31 | 1.19 ~ 1.2 | 1% | 150 (constant) | ε+γ'phase |
| | Comparative Example | | P=21.5, I=129, D=32 | — | — | Forcibly stopped because of negative pressure in furnace | — |
| Treatment ⑦ | Example | 0.8 | P=5.7, I=135, D=34 | 0.79 ~ 0.8 | 1% | 150 (constant) | ε+γ'phase |
| | Comparative Example | | P=21.5, I=129, D=32 | — | — | Forcibly stopped because of negative pressure in furnace | — |
| Treatment ⑧ | Example | 0.5 | P=4.7, I=155, D=39 | 0.5 | 0% | 150 (constant) | γ' phase |
| | Comparative Example | | P=21.5, I=129, D=32 | — | — | Forcibly stopped because of negative pressure in furnace | — |
| Treatment ⑨ | Example | 0.2 | P=3.0, I=249, D=62 | 0.2 | 0% | 150 (constant) | α phase |
| | Comparative Example | | P=21.5, I=129, D=32 | — | — | Forcibly stopped because of negative pressure in furnace | — |
| Treatment ⑩ | Example | 0.1 | P=2.6, I=220, D=54 | 0.1 | 0% | 150 (constant) | α phase |
| | Comparative Example | | P=21.5, I=129, D=32 | — | — | Forcibly stopped because of negative pressure in furnace | — |

SURFACE HARDENING TREATMENT DEVICE AND SURFACE HARDENING TREATMENT METHOD

CROSS-REFERENCE TO RELATED APPLICATION

This is a § 371 application of International Patent Application No. PCT/JP2018/025683 filed Jul. 6, 2018, which claims the benefit of Japanese Patent Application numbers 2017-133910 filed Jul. 7, 2017 and 2017-140503 filed Jul. 20, 2017.

TECHNICAL FIELD

The present invention relates to a surface hardening treatment device and a surface hardening treatment method which can perform a surface hardening treatment, such as nitriding, nitrocarburizing, nitriding quenching (austenitic nitriding), and the like, for a work made of metal.

BACKGROUND ART

Among various surface hardening treatments for a work made of metal such as steel, there is a strong need for nitriding because it is a low distortion treatment. As a specific nitriding method, there are a gas method, a salt bath method, a plasma method, and the like.

Among these methods, the gas method is comprehensively superior when considering quality, environmental properties, mass productivity, and the like. Carburizing, carbonitriding or induction hardening (quenching) involved in hardening a mechanical part causes distortion, but the distortion can be improved when a nitriding treatment by a gas method (gas nitriding treatment) is used. A nitrocarburizing treatment by a gas method (gas nitrocarburizing treatment) involved in carburizing is also known as a treatment of the same kind as the gas nitriding treatment.

The gas nitriding treatment is a process in which only nitrogen is permeated and diffused into a work, in order to harden a surface of the work. In the gas nitriding treatment, an ammonia gas alone, a mixed gas of an ammonia gas and a nitrogen gas, a mixed gas of an ammonia gas and an ammonia decomposition gas (75% hydrogen, 25% nitrogen), or a mixed gas of an ammonia gas, an ammonia decomposition gas and a nitrogen gas, is introduced into a processing furnace in order to perform a surface hardening treatment.

On the other hand, the gas nitrocarburizing treatment is a process in which carbon is secondarily permeated and diffused into a work together with nitrogen, in order to harden a surface of the work. For example, in the gas nitrocarburizing treatment, a mixed gas of an ammonia gas, a nitrogen gas and a carbon dioxide gas ($CO_2$) or a mixed gas of an ammonia gas, a nitrogen gas, a carbon dioxide gas and a carbon monoxide gas (CO) is introduced into a processing furnace in order to perform a surface hardening treatment, as a plurality of furnace introduction gases.

The basis of an atmosphere control in the gas nitriding treatment and in the gas nitrocarburizing treatment is to control a nitriding potential ($K_N$) in a furnace. By controlling the nitriding potential ($K_N$), it is possible to control a volume fraction of the γ' phase ($Fe_4N$) and the ε phase ($Fe_{2-3}N$) in a compound layer generated on a surface of a steel material and/or to achieve a process in which such a compound layer is not generated. That is to say, it is possible to obtain a wide range of nitriding qualities. For example, according to JP-A-2016-211069 (Patent Document 1), the bending fatigue strength and/or the wear resistance of a mechanical part may be improved by selecting the γ' phase and increasing its thickness, which can achieve a further high functionality of the mechanical part.

In the gas nitriding treatment and the gas nitrocarburizing treatment as described above, in order to control an atmosphere in the processing furnace in which the work is arranged, an in-furnace atmospheric gas concentration measurement sensor configured to measure a hydrogen concentration in the furnace or an ammonia concentration in the furnace is installed. Then, the in-furnace nitriding potential is calculated from the measured value of the in-furnace atmospheric gas concentration measurement sensor, and is compared with a target (set) nitriding potential, in order to control the flow rate of each furnace introduction gas ("Heat Treatment", Volume 55, No. 1, pages 7-11 (Yasushi Hiraoka, Yoichi Watanabe)). As for the method of controlling each furnace introduction gas, a method of controlling the total amount while keeping the flow rate ratio between the respective furnace introduction gases constant is well known ("Nitriding and Nitrocarburizing on Iron Materials", second edition (2013), pages 158-163 pages (Dieter Liedtke et al., Agune Technical Center)).

(Fundamentals of the Gas Nitriding Treatment)

The fundamentals of the gas nitriding treatment are chemically explained. In the gas nitriding treatment, in the processing furnace (gas nitriding furnace) in which the work is arranged, a nitriding reaction represented by the following formula (1) occurs.

$$NH_3 \rightarrow [N] + 3/2H_2 \quad (1)$$

At this time, the nitriding potential $K_N$ is defined by the following formula (2).

$$K_N = P_{NH3}/P_{H2}^{3/2} \quad (2)$$

Herein, the partial pressure of ammonia in the furnace is represented by $P_{NH3}$, and the partial pressure of hydrogen in the furnace is represented by $P_{H2}$. The nitriding potential $K_N$ is well known as an index representing the nitriding ability of the atmosphere in the gas nitriding furnace.

On the other hand, in the furnace during the gas nitriding treatment, a part of the ammonia gas introduced into the furnace is thermally decomposed into a hydrogen gas and a nitrogen gas according to a reaction represented by the following formula (3).

$$NH_3 \rightarrow 1/2N_2 + 3/2H_2 \quad (3)$$

In the furnace, the thermal decomposition reaction represented by the formula (3) mainly (dominantly) occurs, and the nitriding reaction represented by the formula (1) is almost negligible quantitatively. Therefore, if the in-furnace ammonia concentration consumed in the reaction represented by the formula (3) or the hydrogen gas concentration generated in the reaction represented by the formula (3) is known, the nitriding potential can be calculated. That is to say, since 1.5 mol of hydrogen and 0.5 mol of nitrogen are generated from 1 mol of ammonia, if the in-furnace ammonia concentration is measured, the in-furnace hydrogen concentration can also be known and thus the nitriding potential can be calculated. Alternatively, if the in-furnace hydrogen concentration is measured, the in-furnace ammonia concentration can also be known, and thus the nitriding potential can also be calculated.

The ammonia gas that has been introduced (flown) into the gas nitriding furnace is circulated through the furnace and then discharged outside the furnace. That is to say, in the gas nitriding treatment, a fresh (new) ammonia gas is continuously flown into the furnace with respect to the existing gases in the furnace, so that the existing gases are continuously discharged out of the furnace (extruded at the supply pressure).

Herein, if the flow rate of the ammonia gas introduced into the furnace is small, the gas residence time thereof in the furnace becomes long, so that the amount of the ammonia gas to be thermally decomposed increases, which increases the amount of the sum of the nitrogen gas and the hydrogen gas generated by the thermal decomposition reaction. On the other hand, if the flow rate of the ammonia gas introduced into the furnace is large, the amount of the ammonia gas to be discharged outside the furnace without being thermally decomposed increases, which decreases the amount of the sum of the nitrogen gas and the hydrogen gas generated by the thermal decomposition reaction.

(Fundamentals of the Flow Rate Control)

Next, the fundamentals of the flow rate control are explained in the case wherein an ammonia gas is used as a solo (single) furnace introduction gas. When the degree of thermal decomposition of the ammonia gas introduced into the furnace is represented by s ($0<s<1$), the gas reaction in the furnace is represented by the following formula (4).

$$NH_3 \rightarrow (1-s)/(1+s)NH_3+0.5s/(1+s)N_2+1.5s/(1+s)H_2 \quad (4)$$

Herein, the left side represents the furnace introduction gas (ammonia gas only), the right side represents the in-furnace atmospheric gases (gas composition) including a part of the ammonia gas remained without being thermally decomposed, and the nitrogen gas and the hydrogen gas generated in the ratio of 1:3 by the thermal decomposition of the ammonia gas. Therefore, when the hydrogen concentration in the furnace is measured by means of a hydrogen sensor, 1.5s/(1+s) on the right side corresponds to the measured value of the hydrogen sensor, and thus the degree of the thermal decompositions of the ammonia gas introduced into the furnace can be calculated from the measured value. Thereby, the ammonia concentration in the furnace corresponding to (1−s)/(1+s) on the right side can also be calculated. That is to say, the in-furnace hydrogen concentration and the in-furnace ammonia concentration can be known only from the measured value of the hydrogen sensor. Thus, the nitriding potential can be calculated.

Similarly, even when a plurality of furnace introduction gases are used, it is possible to control the nitriding potential $K_N$. For example, when an ammonia gas and a nitrogen gas are used as two furnace introduction gases and the introduction ratio therebetween is x y (both x and y are known, and x+y=1. For example, if x=0.5, y=1−0.5=0.5 ($NH_3$:$N_2$=1:1), the gas reaction in the furnace is represented by the following formula (5).

$$xNH_3+(1-x)N_2 \rightarrow x(1-s)/(1+sx)NH_3+(0.5sx+1-x)/(1+sx)N_2+1.5sx/(1+sx)H_2 \quad (5)$$

Herein, the right side represents the in-furnace atmospheric gases (gas composition) including a part of the ammonia gas remained without being thermally decomposed, the nitrogen gas and the hydrogen gas generated in the ratio of 1:3 by the thermal decomposition of the ammonia gas, and the nitrogen gas remained as introduced on the left side (without being decomposed in the furnace). Now, in the hydrogen concentration on the right side, i.e., 1.5sx/(1+sx), x is known (for example, x=0.5), and thus only the degree of the thermal decomposition s of the ammonia gas introduced into the furnace is unknown. Therefore, in the same way as in the formula (4), the degree of the thermal decomposition s of the ammonia gas introduced into the furnace can be calculated from the measured value of the hydrogen sensor. Thereby, the ammonia concentration in the furnace can also be calculated. Thus, the nitriding potential can be calculated.

When the introduction ratio between the respective furnace introduction gases is not fixed, the in-furnace hydrogen concentration and the in-furnace ammonia concentration include two variables, i.e., the degree of the thermal decomposition s of the ammonia gas introduced into the furnace and the introduction ratio x of the ammonia gas. In general, a mass flow controller (MFC) is used as a device for controlling each gas flow rate. Thus, the introduction ratio x of the ammonia gas can be continuously read out as a digital signal based on flow rate values of the respective gases. Therefore, the nitriding potential can be calculated based on the formula (5) by combining this introduction ratio x and the measured value of the hydrogen sensor.

The Patent Document 1 cited in the present specification is JP-A-2016-211069.

The Non-patent Document 1 cited in the present specification is "Heat Treatment", Volume 55, No. 1, pages 7-11 (Yasushi Hiraoka, Yoichi Watanabe). The Non-patent Document 2 cited in the present specification is "Nitriding and Nitrocarburizing on Iron Materials", second edition (2013), pages 158-163 pages (Dieter Liedtke et al., Agune Technical Center). The Non-patent Document 3 cited in the present specification is "Effect of Compound Layer Thickness Composed of γ'-$Fe_4N$ on Rotated-Bending Fatigue Strength in Gas-Nitrided JIS-SCM435 Steel", Materials Transactions, Vol. 58, No. 7 (2017), pages 993-999 (Y. Hiraoka and A. Ishida).

SUMMARY OF INVENTION

Technical Problem

However, the present inventors have found that the conventional method of controlling the nitriding potential by increasing or decreasing the total introduction amount while keeping the flow rate ratio between the furnace introduction gases constant has the following problems.

That is to say, when controlled toward a lower nitriding potential, the total introduction amount is reduced. Herein, if the total introduction amount is excessively reduced, a negative pressure may be generated in the furnace, which may cause a safety problem.

On the other hand, when controlled toward a higher nitriding potential, the total introduction amount is increased. Herein, if the total introduction amount is excessively increased, an ammonia treatment capacity of an exhaust gas treatment device may be exceeded, which may cause an environmental problem.

Therefore, according to the conventional method of controlling the nitriding potential by increasing or decreasing the total introduction amount while keeping the flow rate ratio between the furnace introduction gases constant, a controllable range of the nitriding potential is relatively narrow.

Furthermore, decomposition of the ammonia gas in the furnace occurs on a surface of the work, a surface of a furnace wall or a jig, and the like. Thus, the amount of the decomposition of the ammonia gas greatly depends on a furnace body structure and/or a furnace material surface state. Therefore, it is desirable that a gas-introduction-amount control device is capable of controlling a wider range of the nitriding potential so as to flexibly cope with various processing furnaces.

In particular, in order to improve mechanical properties such as fatigue properties of a steel material or the like, for example in a low alloy steel, it is necessary to selectively form a γ' phase on a steel surface. For that purpose, it is necessary to achieve a nitriding potential in the range of 0.1 to 0.6. Furthermore, it is also desirable to change the target nitriding potential during the process for the same work ("Effect of Compound Layer Thickness Composed of γ'-$Fe_4N$ on Rotated-Bending Fatigue Strength in Gas-Nitrided JIS-SCM435 Steel", Materials Transactions, Vol. 58, No. 7 (2017), pages 993-999 (Y. Hiraoka and A. Ishida)). However, according to the conventional method, the controllable range of the nitriding potential is narrow, and thus it is difficult to achieve a desired control.

The present inventors have repeated diligent examination and various experiments, and have confirmed that the effectiveness of a nitriding potential control by changing the flow rate ratio between the furnace introduction gases while keeping the total introduction amount constant can be enhanced by finely changing setting parameter values of a PD control method based on a target nitriding potential.

The present invention has been made based on the above findings. It is an object of the present invention to provide a surface hardening treatment device and a surface hardening treatment method which are capable of inhibiting generation of the safety problem and/or the environmental problem. It is also an object of the present invention to provide a surface hardening treatment device and a surface hardening treatment method which are capable of achieving a relatively wider controllable range of a nitriding potential.

Solution to Problem

The present invention is a surface hardening treatment device for performing a gas nitriding treatment or a gas nitrocarburizing treatment as a surface hardening treatment for a work arranged in a processing furnace by introducing a plurality of furnace introduction gases into the processing furnace, the plurality of furnace introduction gases including (1) only an ammonia gas, (2) only an ammonia decomposition gas, or (3) only an ammonia gas and an ammonia decomposition gas, as a gas that produces hydrogen in the processing furnace, the surface hardening treatment device including: an in-furnace atmospheric gas concentration detector configured to detect a hydrogen concentration or an ammonia concentration in the processing furnace; an in-furnace nitriding potential calculator configured to calculate a nitriding potential in the processing furnace based on the hydrogen concentration or the ammonia concentration detected by the in-furnace atmospheric gas concentration detector; and a gas-introduction-amount controller configured to control an introduction amount of each of the plurality of furnace introduction gases by changing a flow rate ratio between the plurality of furnace introduction gases while keeping a total introduction amount of the plurality of furnace introduction gases constant, based on the nitriding potential in the processing furnace calculated by the in-furnace nitriding potential calculator and a target nitriding potential, such that the nitriding potential in the processing furnace is brought close to the target nitriding potential.

According to the present invention, an introduction amount of each of the plurality of furnace introduction gases is controlled by changing a flow rate ratio between the plurality of furnace introduction gases while keeping a total introduction amount of the plurality of furnace introduction gases constant, such that the nitriding potential in the processing furnace is brought close to the target nitriding potential. Thus, in comparison with the conventional method of controlling the nitriding potential by increasing or decreasing the total introduction amount while keeping the flow rate ratio between the plurality of furnace introduction gases constant, it is possible to remarkably suppress a change of an in-furnace pressure, which inhibits the generation of the safety problem. In addition, a large amount of ammonia gas is not exhausted, which inhibits the generation of the environmental problem.

In the present invention, it is preferable that the target nitriding potential is set to be different values between time zones for the same work; that the gas-introduction-amount controller is configured to perform a PID control method in which the gas introduction amounts of the plurality of furnace introduction gases are input values, the nitriding potential in the processing furnace calculated by the in-furnace nitriding potential calculator is an output value, and the target nitriding potential is a target value; and that a proportional gain in the PID control method, an integral gain or an integration time in the PID control method, and a differential gain or a differentiation time in the PID control method can be set for each different value of the target nitriding potential.

According to the present inventors' findings, when the PID control method is adopted as a control of increasing or decreasing the flow rate ratio of the furnace introduction gases while keeping the total introduction amount of the furnace introduction gases constant, and when three setting parameter values, i.e., "the proportional gain", "the integral gain or the integration time" and "the differential gain or the differentiation time" are finely changed for each different value of the target nitriding potential, in comparison with the controllable range of the nitriding potential achieved by the conventional method (about 0.6 to 1.5 at 580° C.), it is possible to achieve a wider controllable range of the nitriding potential, in particular on a lower nitriding potential side (for example, about 0.05 to 1.3 at 580° C.).

Thus, in the present invention, it is preferable that the target nitriding potential is set to be in a range of 0.05 to 1.3, for example at 580° C.

In addition, in the present invention, since the wider controllable range of the nitriding potential (for example, about 0.05 to 1.3 at 580° C.) is achieved, the target nitriding potential can be set more flexibly to be different values between time zones for the same work. For example, the target nitriding potential can be set to be three or more different values between time zones for the same work.

In addition, the present invention is a surface hardening treatment method of performing a gas nitriding treatment or a gas nitrocarburizing treatment as a surface hardening treatment for a work arranged in a processing furnace by introducing a plurality of furnace introduction gases into the processing furnace, the plurality of furnace introduction gases including (1) only an ammonia gas, (2) only an ammonia decomposition gas, or (3) only an ammonia gas and an ammonia decomposition gas, as a gas that produces hydrogen in the processing furnace, the surface hardening treatment method including: an in-furnace atmospheric gas concentration detecting step of detecting a hydrogen concentration or an ammonia concentration in the processing furnace; an in-furnace nitriding potential calculating step of calculating a nitriding potential in the processing furnace based on the hydrogen concentration or the ammonia concentration detected at the in-furnace atmospheric gas concentration detecting step; and a gas-introduction-amount controlling step of controlling an introduction amount of each of the plurality of furnace introduction gases by changing a flow rate ratio between the plurality of furnace introduction gases while keeping a total introduction amount of the plurality of furnace introduction gases constant, based on the nitriding potential in the processing furnace calculated at the in-furnace nitriding potential calculating step and a target nitriding potential, such that the nitriding potential in the processing furnace is brought close to the target nitriding potential.

In the present method, it is preferable that the target nitriding potential is set to be different values between time zones for the same work; that a PID control method, in which the gas introduction amounts of the plurality of furnace introduction gases are input values, the nitriding potential in the processing furnace calculated at the in-furnace nitriding potential calculating step is an output value, and the target nitriding potential is a target value, is performed at the gas-introduction-amount controlling step; and that a proportional gain in the PID control method, an integral gain or an integration time in the PID control method, and a differential gain or a differentiation time in the PID control method can be set for each different value of the target nitriding potential.

Effects of Invention

According to the present invention, an introduction amount of each of the plurality of furnace introduction gases is controlled by changing a flow rate ratio between the plurality of furnace introduction gases while keeping a total introduction amount of the plurality of furnace introduction gases constant, such that the nitriding potential in the processing furnace is brought close to the target nitriding potential. Thus, in comparison with the conventional method of controlling the nitriding potential by increasing or decreasing the total introduction amount while keeping the flow rate ratio between the plurality of furnace introduction gases constant, it is possible to remarkably suppress a change of an in-furnace pressure, which inhibits the generation of the safety problem. In addition, a large amount of ammonia gas is not exhausted, which inhibits the generation of the environmental problem.

In addition, in the present invention, when a PID control method is adopted as a control of increasing or decreasing the flow rate ratio of the furnace introduction gases while keeping the total introduction amount of the furnace introduction gases constant, and when three setting parameter values, i.e., "a proportional gain", "an integral gain or an integration time" and "a differential gain or a differentiation time" are finely changed for each different value of the target nitriding potential, in comparison with the controllable range of the nitriding potential achieved by the conventional method (about 0.6 to 1.5 at 580° C.), it is possible to achieve a wider controllable range of the nitriding potential, in particular on a lower nitriding potential side (for example, about 0.05 to 1.3 at 580° C.).

BRIEF DESCRIPTION OF DRAWINGS

FIG. 2 is a table showing results of nitriding potential controls as examples and comparative examples;

FIG. 7 is a table showing results of nitriding potential controls as additional examples and additional comparative examples.

DESCRIPTION OF EMBODIMENTS

Hereinafter, a preferable embodiment of the present invention will be described. However, the present invention is not limited to the embodiment.

(Structure)

Figure 1:
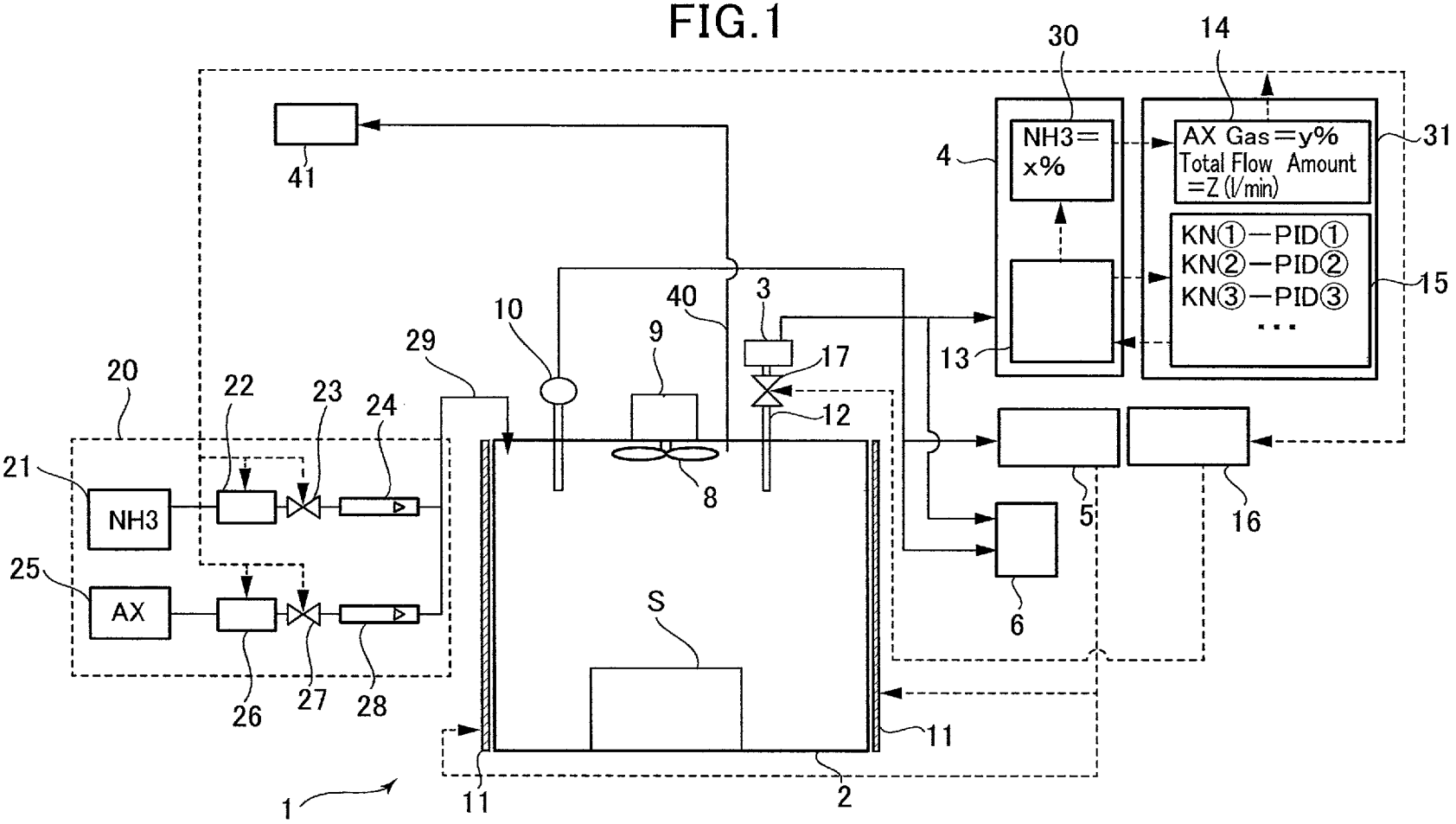
FIG. 1 is a schematic view showing a surface hardening treatment device according to an embodiment of the present invention.

FIG. 1 is a schematic view showing a surface hardening treatment device according to an embodiment of the present invention. As shown in FIG. 1, the surface hardening treatment device 1 of the present embodiment is a surface hardening treatment device for performing a gas nitriding treatment as a surface hardening treatment for a work S arranged in a processing furnace 2 by selectively introducing a plurality of furnace introduction gases into the processing furnace 2, wherein the plurality of furnace introduction gases includes, as a gas that produces hydrogen in the processing furnace 2, (1) only an ammonia gas, (2) only an ammonia decomposition gas, or (3) only an ammonia gas and an ammonia decomposition gas.

The work S is made of metal. For example, the work S is a steel part or a mold. The plurality of furnace introduction gases may be mixed and subsequently introduced into the processing furnace 2, or may be individually introduced into the processing furnace 2 and subsequently mixed in the processing furnace 2. Herein, explained is a case wherein the gas that produces hydrogen in the processing furnace 2 includes (3) only an ammonia gas and an ammonia decomposition gas. The ammonia decomposition gas is a gas called AX gas, and is a mixed gas composed of nitrogen and hydrogen in a ratio of 1:3.

In addition, as shown in FIG. 1, the processing furnace 2 of the surface hardening processing device 1 of the present embodiment includes: a stirring fan 8, a stirring drive motor 9, an in-furnace temperature measuring device 10, a furnace body heater 11, an atmospheric gas concentration detector 3, a nitriding potential adjustor 4, a temperature adjustor 5, a programmable logic controller 31, a recorder 6, and a furnace introduction gas supplier 20.

The stirring fan 8 is disposed in the processing furnace 2 and configured to rotate in the processing furnace 2 in order to stir atmospheric gases in the processing furnace 2. The stirring fan drive motor 9 is connected to the stirring fan 8 and configured to cause the stirring fan 8 to rotate at an arbitrary rotation speed.

The in-furnace temperature measuring device 10 includes a thermocouple and is configured to measure a temperature of the in-furnace gases existing in the processing furnace 2. In addition, after measuring the temperature of the in-furnace gases, the in-furnace temperature measuring device 10 is configured to output an information signal including the measured temperature (in-furnace temperature signal) to the temperature adjustor 5 and the recorder 6.

The atmospheric gas concentration detector 3 is composed of a sensor capable of detecting a hydrogen concentration or an ammonia concentration in the processing furnace 2 as an in-furnace atmospheric gas concentration. A main body of the sensor communicates with an inside of the processing furnace 2 via an atmospheric gas pipe 12. In the present embodiment, the atmospheric gas pipe 12 is formed as a single-line path that directly communicates the sensor main body of the atmospheric gas concentration detector 3 and the processing furnace 2. An on-off valve 17 is provided in the middle of the atmospheric gas pipe 12, and configured to be controlled by an on-off valve controller 16.

In addition, after detecting the in-furnace atmospheric gas concentration, the atmospheric gas concentration detector 3 is configured to output an information signal including the detected concentration to the nitriding potential adjustor 4 and the recorder 6.

The recorder 6 includes a CPU and a storage medium such as a memory. Based on the signals outputted from the in-furnace temperature measurement device 10 and the atmospheric gas concentration detector 3, the recorder 6 is configured to record the temperature and/or the atmospheric gas concentration in the processing furnace 2, for example in correspondence with the date and time when the surface hardening treatment is performed.

The nitriding potential adjuster 4 includes an in-furnace nitriding potential calculator 13 and a gas flow rate output adjustor 30. The programmable logic controller 31 includes a gas introduction controller 14 and a parameter setting device 15.

The in-furnace nitriding potential calculator 13 is configured to calculate a nitriding potential in the processing furnace 2 based on the hydrogen concentration or the ammonia concentration detected by the atmospheric gas concentration detector 3. Specifically, calculation formulas for the nitriding potential are programmed dependent on the actual furnace introduction gases in accordance with the same theory as the above formula (5), and incorporated in the in-furnace nitriding potential calculator 13, so that the nitriding potential is calculated from the value of the in-furnace atmospheric gas concentration.

For example, the parameter setting device 15 is composed of a touch panel. Through the parameter setting device 15, the target nitriding potential can be set and inputted to be different values depending on time zones for the same work. In addition, through the parameter setting device 15, setting parameter values for a PID control method can be set and inputted for each different value of the target nitriding potential. Specifically, "a proportional gain", "an integral gain or an integration time", and "a differential gain or a differentiation time" for the PID control method can be set and inputted for each different value of the target nitriding potential. The set and inputted setting parameter values are transferred to the gas flow rate output adjustor 30.

The gas flow rate output adjustor 30 is configured to perform the PID control method in which respective gas introduction amounts of the plurality of furnace introduction gases are input values, the nitriding potential calculated by the in-furnace nitriding potential calculator 13 is an output value, and the target nitriding potential (the set nitriding potential) is a target value. More specifically, in the present PID control method, the nitriding potential in the processing furnace 2 is brought close to the target nitriding potential by changing a flow rate ratio between the plurality of furnace introduction gases while keeping a total introduction amount of the plurality of furnace introduction gases constant. In addition, in the present PID control method, the setting parameter values that have been transferred from the parameter setting device 15 are used.

Before the setting and inputting operation against the parameter setting device 15, it is necessary to perform pilot processes to obtain in advance candidate values for the setting parameter values of the PID control method. According to a conventional apparatus that has been manufactured by the present applicant, the setting parameter values of a PID control method are obtained by an auto-tuning function that the nitriding potential adjustor 4 has in itself, dependent on (1) a state of the processing furnace (a state of a furnace wall and/or a jig), (2) a temperature condition of the processing furnace, and (3) a state of the work (type and/or the number of parts). In contrast, according to the present embodiment, even if (1) a state of the processing furnace (a state of a furnace wall and/or a jig), (2) a temperature condition of the processing furnace and (3) a state of the work (type and/or the number of parts) are the same, it is necessary to obtain in advance candidate values for the setting parameter values (4) for each different value of the target nitriding potential, by an auto-tuning function that the nitriding potential adjustor 4 has in itself. In order to embody the nitriding potential adjustor 4 having such an auto-tuning function, a "UT75A" manufactured by Yokogawa Electric Co., Ltd. (a high-functional digital indicating controller, http://www.yokogawa.co.jp/ns/cis/utup/utadvanced/ns-ut75a-01-ja.htm) or the like can be used.

The setting parameter values (a set of "the proportional gain", "the integral gain or the integration time" and "the derivative gain or the derivative time") obtained as the candidate values can be recorded in some manner, and then can be manually inputted to the parameter setting device 15. Alternatively, the setting parameter values obtained as the candidate values can be stored in some storage device in a manner associated with the target nitriding potential, and then can be automatically read out by the parameter setting device 15 based on the set and inputted value of the target nitriding potential.

The gas flow rate output adjustor 30 is configured to control the introduction amount of each of the plurality of furnace introduction gases as a result of the PID control method. Specifically, the gas flow rate output adjustor 30 determines a flow rate ratio of the ammonia gas as a value within 0 to 100%. Instead of the flow rate ratio of the ammonia gas, a flow rate ratio of the ammonia decomposition gas may be determined. In any case, since the sum of the two flow rate ratios is 100%, when one flow rate ratio is determined, the other flow rate ratio is also determined. Then, the output values from the gas flow rate output adjustor 30 are transferred to the gas introduction amount controller 14.

The gas introduction amount controller 14 is configured to transmit control signals to a first supply amount controller 22 for the ammonia gas and a second supply amount controller 26 for the ammonia decomposition gas, respectively, in order to realize an introduction amount of each gas corresponding to the total introduction amount (total flow rate)×the flow rate ratio of each gas. In the present embodiment, the total introduction amount of the respective gases can also be set and inputted by the parameter setting device 15 for each different value of the target nitriding potential.

The furnace introduction gas supplier 20 of the present embodiment includes a first furnace introduction gas supplier 21 for the ammonia gas, the first supply amount controller 22, a first supply valve 23 and a first flow meter 24. In addition, the furnace introduction gas supplier 20 of the present embodiment includes a second furnace introduction gas supplier 25 for the ammonia decomposition gas (AX gas), the second supply amount controller 26, a second supply valve 27 and a second flow meter 28.

In the present embodiment, the ammonia gas and the ammonia decomposition gas are mixed in a furnace introduction gas pipe 29 before entering the processing furnace 2.

The first furnace introduction gas supplier 21 is formed by, for example, a tank filled with a first furnace introduction gas (in this example, the ammonia gas).

The first supply amount controller 22 is formed by a mass flow controller, and is interposed between the first furnace introduction gas supplier 21 and the first supply valve 23. An opening degree of the first supply amount controller 22 changes according to the control signal outputted from the gas introduction amount controller 14. In addition, the first supply amount controller 22 is configured to detect a supply amount from the first furnace introduction gas supplier 21 to the first supply valve 23, and output an information signal including the detected supply amount to the gas introduction amount controller 14 and the recorder 6. This information signal can be used for correction or the like of the control performed by the gas introduction amount controller 14.

The first supply valve 23 is formed by an electromagnetic valve configured to switch between opened and closed states according to a control signal outputted from the gas introduction amount controller 14, and is interposed between the first supply amount controller 22 and the first flow meter 24.

The first flow meter 24 is formed by, for example, a mechanical flow meter such as a flow-type flow meter, and is interposed between the first supply valve 23 and the furnace introduction gas pipe 29. The first flow meter 24 detects a supply amount from the first supply valve 23 to the furnace introduction gas pipe 29. The supply amount detected by the first flow meter 24 can be provided for an operator's visual confirmation.

The second furnace introduction gas supplier 25 is formed by, for example, a tank filled with a second furnace introduction gas (in this example, the ammonia decomposition gas).

The second supply amount controller 26 is formed by a mass flow controller, and is interposed between the second furnace introduction gas supplier 25 and the second supply valve 27. An opening degree of the second supply amount controller 26 changes according to the control signal outputted from the gas introduction amount controller 14. In addition, the second supply amount controller 26 is configured to detect a supply amount from the second furnace introduction gas supplier 25 to the second supply valve 27, and output an information signal including the detected supply amount to the gas introduction amount controller 14 and the recorder 6. This information signal can be used for correction or the like of the control performed by the gas introduction amount controller 14.

The second supply valve 27 is formed by an electromagnetic valve configured to switch between opened and closed states according to a control signal outputted from the gas introduction amount controller 14, and is interposed between the second supply amount controller 26 and the second flow meter 28.

The second flow meter 28 is formed by, for example, a mechanical flow meter such as a flow-type flow meter, and is interposed between the second supply valve 27 and the furnace introduction gas pipe 29. The second flow meter 28 detects a supply amount from the second supply valve 26 to the furnace introduction gas pipe 29. The supply amount detected by the second flow meter 28 can be provided for an operator's visual confirmation.

(Operation)

Next, an operation of the surface hardening treatment device 1 according to the present embodiment is explained. First, a work S to be processed is put into the processing furnace 2, and then the processing furnace 2 starts to be heated. Thereafter, a mixed gas of the ammonia gas and the ammonia decomposition gas is introduced from the furnace introduction gas supplier 20 into the processing furnace 2 at a setting initial flow rate. The setting initial flow rate can also be set and inputted by the parameter setting device 15, and is controlled by the first supply amount controller 22 and the second supply amount controller 26 (both of them are mass flow controllers). Furthermore, the stirring fan drive motor 9 is driven and thus the stirring fan 8 rotates to stir the atmospheric gases in the processing furnace 2.

In the initial state, the on-off valve controller 16 closes the on-off valve 17. In general, as a pretreatment for the gas nitriding treatment, a treatment for activating a steel surface to make it easy for nitrogen to enter may be performed. In this case, a hydrogen chloride gas and/or a hydrogen cyanide gas or the like may be generated in the furnace. These gases may deteriorate the atmospheric gas concentration detector (sensor) 3, and thus it is effective to keep the on-off valve 17 closed.

In addition, the in-furnace temperature measurement device 10 measures a temperature of the in-furnace gases, and outputs an information signal including the measured temperature to the nitriding potential adjustor 4 and the recorder 6. The nitriding potential adjustor 4 judges whether the state in the processing furnace 2 is still during the temperature rising step or already after the temperature rising step has been completed (a stable state).

In addition, the in-furnace nitriding potential calculator 13 of the nitriding potential adjustor 4 calculates an in-furnace nitriding potential (which is initially an extremely high value (since no hydrogen gas exists in the furnace), but decreases as decomposition of the ammonia gas (generation of the hydrogen gas) proceeds) and judges whether the calculated value has dropped lower than the sum of the target nitriding potential and a standard margin. This standard margin can also be set and inputted by the parameter setting device 15, and is for example 2.5.

When it is determined that the temperature rising step has been completed and also it is determined that the calculated value of the in-furnace nitriding potential has dropped lower than the sum of the target nitriding potential and the standard margin, the nitriding potential adjustor 4 starts to control an introduction amount of each of the plurality of furnace introduction gases via the gas introduction amount controller 14. Herein, the on-off valve controller 16 opens the on-off valve 17.

When the on-off valve 17 is opened, the processing furnace 2 and the atmospheric gas concentration detector 3 communicate with each other, and then the atmospheric gas concentration detector 3 detects an in-furnace hydrogen concentration or an in-furnace ammonia concentration. The detected hydrogen concentration signal or ammonia concentration signal is outputted to the nitriding potential adjustor 4 and the recorder 6.

The in-furnace nitriding potential calculator 13 of the nitriding potential adjustor 4 calculates the in-furnace nitriding potential based on the inputted hydrogen concentration signal or ammonia concentration signal. Then, the gas flow rate output adjustor 30 performs the PID control method in which the respective gas introduction amounts of the plurality of furnace introduction gases are input values, the nitriding potential calculated by the in-furnace nitriding potential calculator 13 is an output value, and the target nitriding potential (the set nitriding potential) is a target value. Specifically, in the present PID control method, the nitriding potential in the processing furnace 2 is brought close to the target nitriding potential by changing the flow rate ratio between the plurality of furnace introduction gases while keeping the total introduction amount of the plurality of furnace introduction gases constant. In the present PID control method, the setting parameter values that have been set and inputted by the parameter setting device 15 are used. One feature of the present embodiment is that the setting parameter values are different depending on values of the target nitriding potential.

Then, the gas flow rate output adjustor 30 controls the introduction amount of each of the plurality of furnace introduction gases as a result of the PID control method. Specifically, the gas flow rate output adjustor 30 determines the flow rate ratio of the ammonia gas as a value within 0 to 100%, and the output values from the gas flow rate output adjustor 30 are transferred to the gas introduction amount controller 14.

The gas introduction amount controller 14 transmits control signals to the first supply amount controller 22 for the ammonia gas and the second supply amount controller 26 for the ammonia decomposition gas, respectively, in order to realize the introduction amount of each gas corresponding to the total introduction amount x the flow rate ratio of each gas.

According to the control as described above, the in-furnace nitriding potential can be stably controlled in the vicinity of the target nitriding potential. Thereby, the surface hardening treatment of the work S can be performed with extremely high quality.

(Examples and Comparative Examples)

Surface hardening treatments were actually performed according to the surface hardening treatment device 1 of the present embodiment as described above (Examples). On the other hand, surface hardening treatments were also performed according to the conventional control method (Comparative Examples).

In both the examples and the comparative examples, a batch type gas nitriding furnace (processing weight: 800 kg/gross) was used as the processing furnace, and the in-furnace temperature thereof during processing was set to be 580° C. (about 560 to 600° C.). In addition, a heat conduction type hydrogen sensor was used as the atmospheric gas concentration detector. In addition, JIS-SCM435 steel was used as the work S. Furthermore, a switching period of each of the first supply amount controller 22 and the second supply amount controller 26 (both of them are mass flow controllers) was set to be 1 second, and each processing time was set to be 2 hours.

On the other hand, in the comparative examples, instead of the ammonia decomposition gas, a nitrogen gas was used as the second furnace introduction gas.

In addition, in the comparative examples, a PID control method was performed. However, in the PID control method in the comparative examples, the nitriding potential in the processing furnace was brought close to the target nitriding potential by changing the total introduction amount of the plurality of furnace introduction gases while keeping the flow rate ratio between the plurality of furnace introduction gases constant ($NH_3$:$N_2$=9:1).

Furthermore, in the PID control method in the comparative examples, the same setting parameter values (the set of "the proportional gain", "the integral gain or the integration time" and "the derivative gain or the derivative time") were used for different values of the target nitriding potential.

As the target nitriding potential, ten different values were used as shown in FIG. 2. In the gas nitriding treatment around 580° C. (about 560 to 600° C.), the condition of $K_N$=0.1 is a condition in order that no compound layer is generated. The condition of $K_N$=0.2 to 1.0 is a condition in order that the γ' phase is generated as a compound layer. The condition of $K_N$=1.5 to 2.0 is a condition in order that only the c phase is generated on a surface. In particular, it is known that the condition of $K_N$=0.3 or the vicinity is a condition in order that the γ' phase (which is important for practical use) can be generated as almost a single phase on a surface.

The surface-treated structure of the work S was actually identified by an X-ray diffraction method.

The results of the control range of the nitriding potential in the furnace are shown as a table in FIG. 2. In addition, the controllable ranges of the nitriding potential by the examples and the comparative examples are shown in FIG. 3, in which the vertical axis represents a control error (a maximum error %) and the horizontal axis represents the nitriding potential.

Figures 3, 4:
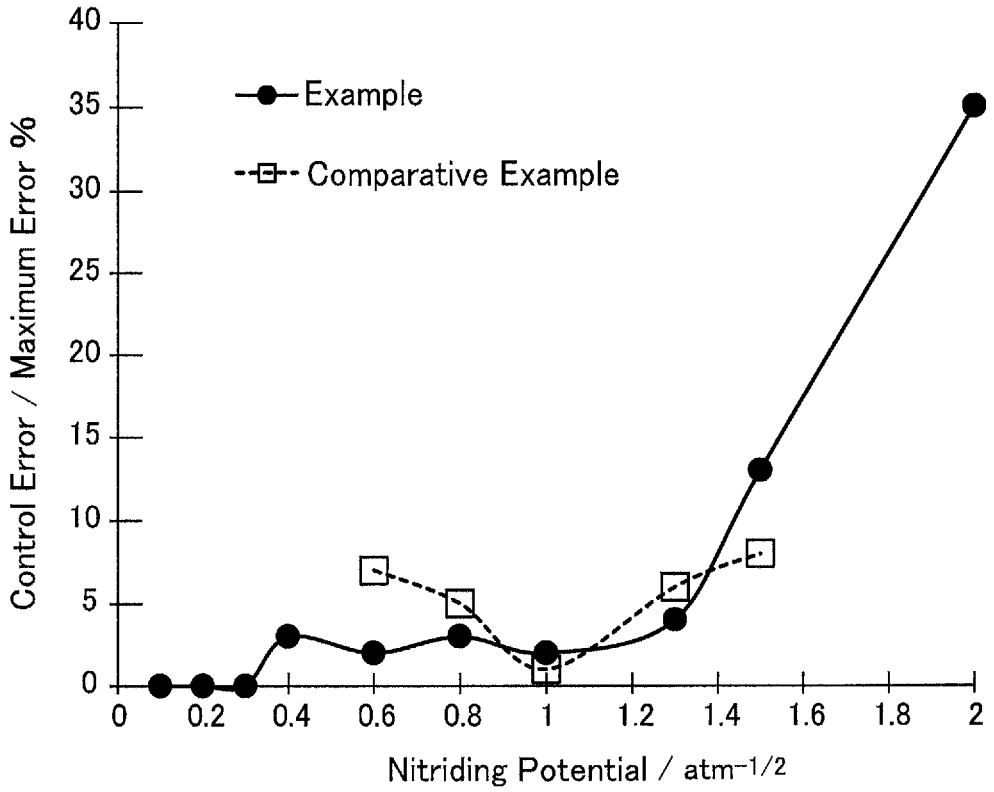
FIG. 3 is a graph for comparing controllable ranges of the nitriding potential at 580° C. (560° C. to 600° C.)
FIG. 4 is a table showing various setting values of a control example in which the target nitriding potential is set to be different values between time zones.

As shown in FIGS. 2 and 3, in the examples, it was possible to control the nitriding potential within a range of 0.1 to 1.3. In addition, it was possible to achieve a treatment of high precision with an error smaller than those in the comparative examples, by finely changing the setting parameter values of the PID control method for each value of the target nitriding potential. In addition, in the case wherein the target nitriding potential was set to be 0.3 or 0.2, generation of the γ' phase (which is important for practical use) was confirmed on a surface of the work S.

However, in the examples, in the case wherein the target nitriding potential was set to be 1.5 to 2.0, the error was very large. This is presumed to be caused by the restriction of the total introduction amount (in these examples, 150 (l/min)).

On the other hand, in the comparative examples, it was possible to control the nitriding potential within a range of 0.6 to 1.5.

However, in the comparative examples, in the case wherein the target nitriding potential was set to be lower than 0.6, in order to reduce the nitriding potential, the total introduction amount of the furnace introduction gases was excessively decreased such that an excessive negative pressure was generated in the furnace. Therefore, the inside of the furnace was replaced with a nitrogen gas and the surface hardening treatment was forcibly stopped (treatment 7 to treatment 10).

In addition, in the case wherein the target nitriding potential was set to be 2.0, the amount of the ammonia gas in the exhaust gas exceeded the capability of an exhaust gas combustion decomposition apparatus 41 which combusts and decomposes the exhaust gas, and the operator complained of eye pain. Therefore, the inside of the furnace was replaced with a nitrogen gas and the surface hardening treatment was forcibly stopped (treatment 1).

(Control Example in which Target Nitriding Potential is changed depending on Time Zone)

Next, FIG. 4 is a table showing various setting values of a control example in which the target nitriding potential is set to be different values between time zones. In this example, the target nitriding potential is sequentially changed in the following order: 0.2→1.5→0.3. That is to say, in this example, the target nitriding potential is set to be three different values between the time zones for the same work.

Figure 5:
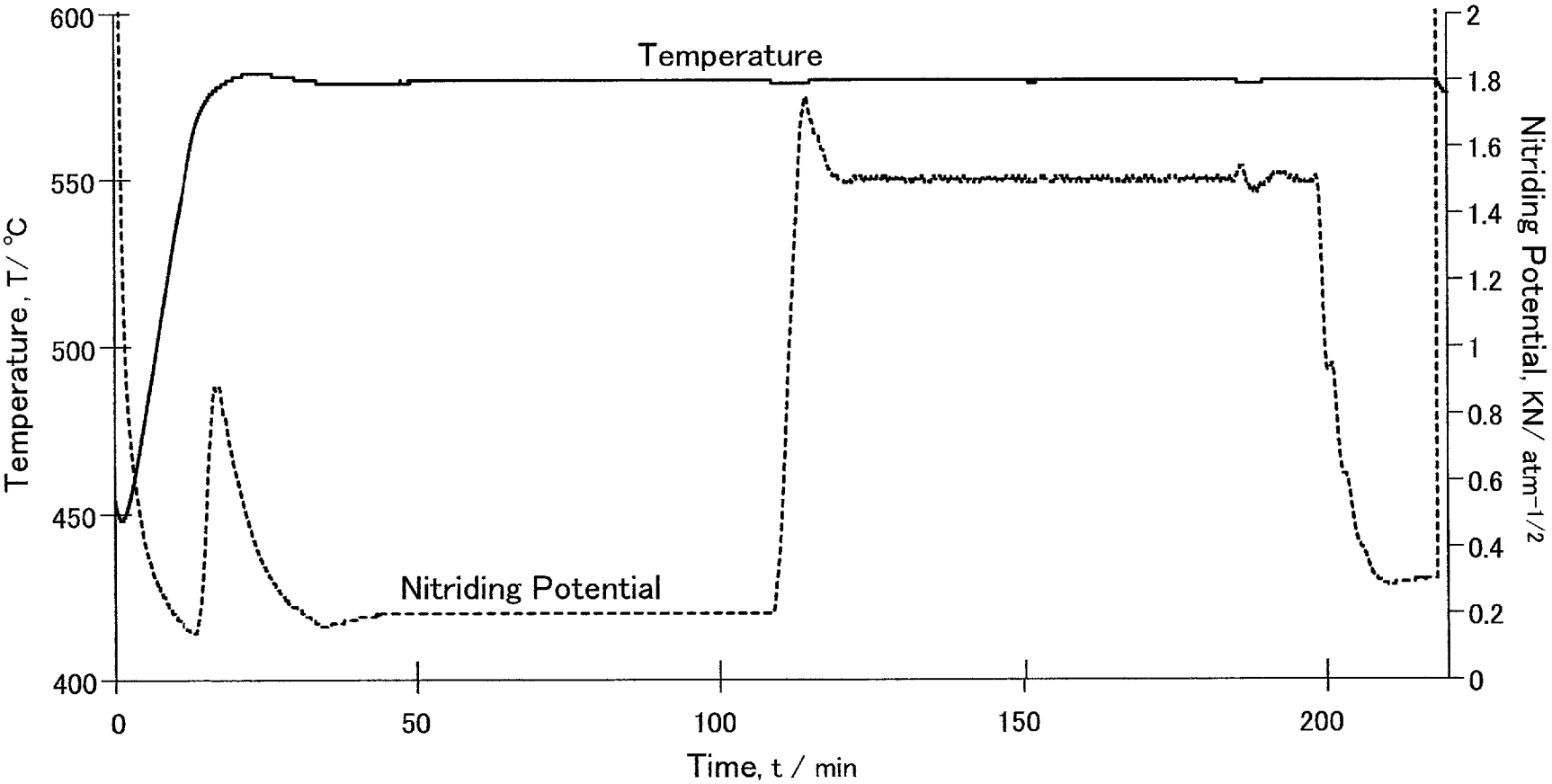
FIG. 5 is a graph showing transition over time of an in-furnace temperature and an in-furnace nitriding potential in case of the control example of FIG. 4.
Figure 6:
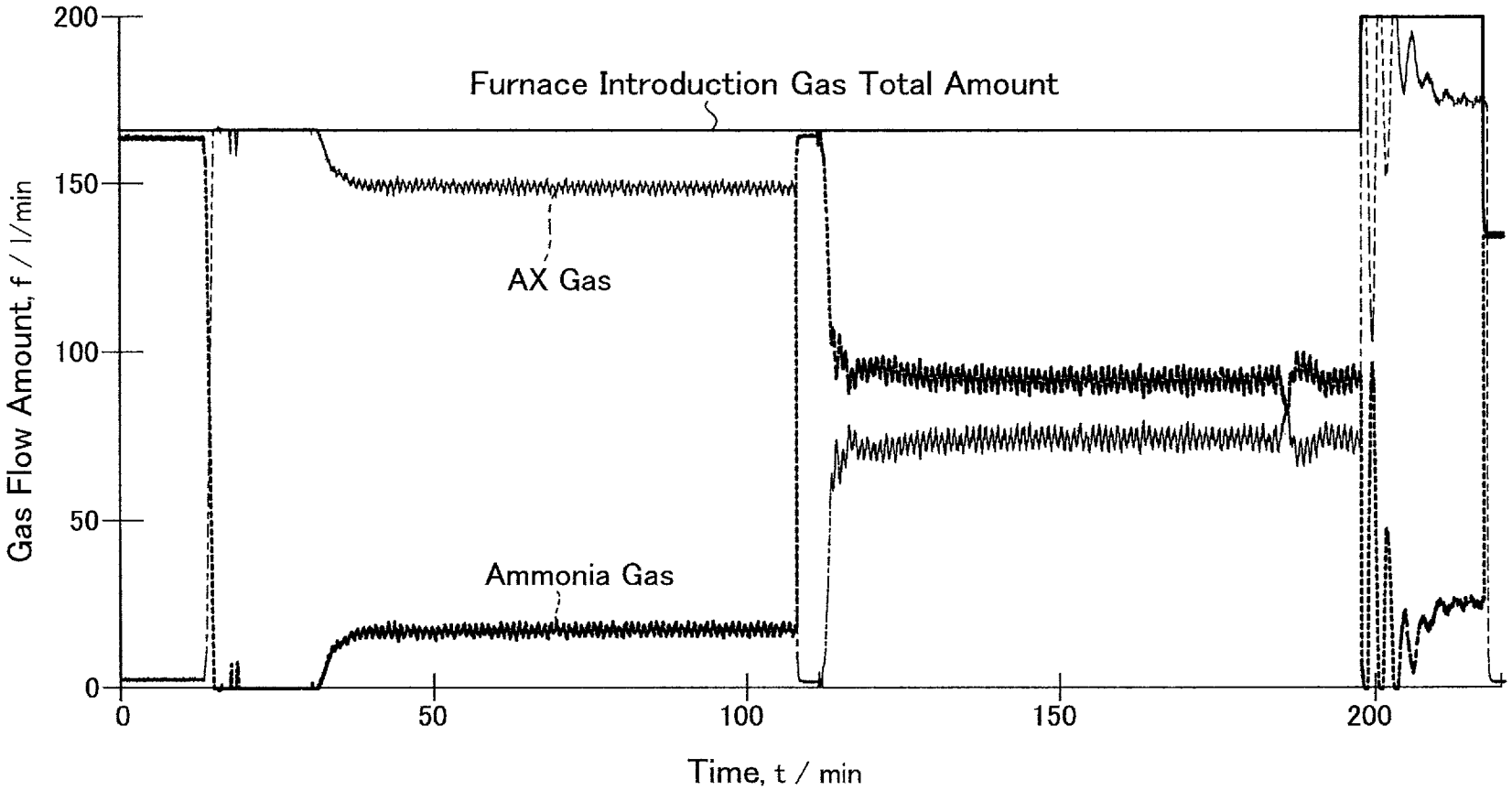
FIG. 6 is a graph showing transition over time of a flow rate of each of furnace introduction gases and a total introduction amount in case of the control example of FIG. 4.

FIG. 5 is a graph showing transition over time of an in-furnace temperature and an in-furnace nitriding potential in case of the control example of FIG. 4. FIG. 6 is a graph showing transition over time of a flow rate of each of furnace introduction gases and a total introduction amount in case of the control example of FIG. 4. As shown in FIGS. 4 to 6, the first step 01 was a temperature rising step, which needed 20 minutes in this example.

Subsequently, as shown in FIG. 4, in the next step 02, the target nitriding potential was set to be 0.2. The setting parameter values of the PID control method were set to be P=3.5, I=209 and D=52. Then, in order to control the nitriding potential, the flow rate ratio of the ammonia gas and the AX gas was allowed to be fluctuated in small increments (see FIG. 6), while the total introduction amount thereof was kept constant at 166 L/min. As a result, as shown in FIG. 5, the in-furnace nitriding potential could be stably controlled to be 0.2 as the target nitriding potential. The step 02 in this example needed 100 minutes.

Subsequently, as shown in FIG. 4, in the next step 03, the target nitriding potential was set to be 1.5. The setting parameter values of the PID control method were set to be P=7.4, I=116 and D=29. Then, in order to control the nitriding potential, the flow rate ratio of the ammonia gas and the AX gas was allowed to be fluctuated in small increments (see FIG. 6), while the total introduction amount thereof was kept constant at 166 L/min. As a result, as shown in FIG. 5, the in-furnace nitriding potential could be stably controlled to be 1.5 as the target nitriding potential. The step 03 in this example needed 100 minutes.

Subsequently, as shown in FIG. 4, in the next step 04, the target nitriding potential was set to be 0.3. The setting parameter values of the PID control method were set to be P=3.9, I=164 and D=41. Then, in order to control the nitriding potential, the flow rate ratio of the ammonia gas and the AX gas was allowed to be fluctuated in small increments (see FIG. 6), while the total introduction amount thereof was kept constant at 200 L/min. As a result, as shown in FIG. 5, the in-furnace nitriding potential could be stably controlled to be 0.3 as the target nitriding potential. The step 04 in this example needed 20 minutes.

As described above, when the PID control method is adopted as a control of increasing or decreasing the flow rate ratio of the furnace introduction gases while keeping the total introduction amount of the furnace introduction gases constant, and when the three setting parameter values are finely changed for each different value of the target nitriding potential, in comparison with the controllable range of the nitriding potential achieved by the conventional method (about 0.6 to 1.5 at 580° C.), it is possible to achieve a wider controllable range of the nitriding potential, in particular on a lower nitriding potential side (for example, about 0.05 to 1.3 at 580° C.). Thus, the target nitriding potential can be set more flexibly to be different values between time zones for the same work. For example, the target nitriding potential can be set to be three or more different values between time zones for the same work.

(Additional Examples and Additional Comparative Examples)

Surface hardening treatments were actually performed according to the surface hardening treatment device 1 of the present embodiment as described above (Examples). On the other hand, surface hardening treatments were also performed according to the conventional control method (Comparative Examples).

In both the examples and the comparative examples, a batch type gas nitriding furnace (processing weight: 800 kg/gross) was used as the processing furnace, and the in-furnace temperature thereof during processing was set to be 500° C. (about 480 to 520° C.). In addition, a heat conduction type hydrogen sensor was used as the atmospheric gas concentration detector. In addition, JIS-SCM435 steel was used as the work S. Furthermore, a switching period of each of the first supply amount controller 22 and the second supply amount controller 26 (both of them are mass flow controllers) was set to be 1 second, and each processing time was set to be 20 hours.

On the other hand, in the comparative examples, instead of the ammonia decomposition gas, a nitrogen gas was used as the second furnace introduction gas.

In addition, in the comparative examples, a PID control method was performed. However, in the PID control method in the comparative examples, the nitriding potential in the processing furnace was brought close to the target nitriding potential by changing the total introduction amount of the plurality of furnace introduction gases while keeping the flow rate ratio between the plurality of furnace introduction gases constant ($NH_3$:$N_2$=9:1).

Furthermore, in the PID control method in the comparative examples, the same setting parameter values (the set of "the proportional gain", "the integral gain or the integration time" and "the derivative gain or the derivative time") were used for different values of the target nitriding potential.

As the target nitriding potential, ten different values were used as shown in FIG. 4. In the gas nitriding treatment around 500° C. (about 480 to 520° C.), the condition of $K_N$=0.1, 0.2 is a condition in order that no compound layer is generated. The condition of $K_N$=0.5 to 1.5 is a condition in order that the γ' phase is generated as a compound layer. The condition of $K_N$=3.0 to 9.0 is a condition in order that only the c phase is generated on a surface. In particular, it is known that the condition of $K_N$=0.5 or the vicinity is a condition in order that the γ' phase (which is important for practical use) can be generated as almost a single phase on a surface.

The surface-treated structure of the work S was actually identified by an X-ray diffraction method.

The results of the control range of the nitriding potential in the furnace are shown as a table in FIG. 4. In addition, the controllable ranges of the nitriding potential by the examples and the comparative examples are shown in FIG. 5, in which the vertical axis represents a control error (a maximum error %) and the horizontal axis represents the nitriding potential.

As shown in FIGS. 4 and 5, in the examples, it was possible to control the nitriding potential within a range of 0.1 to 4.5. In addition, it was possible to achieve a treatment of high precision with an error smaller than those in the comparative examples, by finely changing the setting parameter values of the PID control method for each value of the target nitriding potential. In addition, in the case wherein the target nitriding potential was set to be 0.5, generation of the γ' phase (which is important for practical use) was confirmed on a surface of the work S.

However, in the examples, in the case wherein the target nitriding potential was set to be 6.0 to 9.0, the error was very large. This is presumed to be caused by the restriction of the total introduction amount (in these examples, 150 (l/min)).

On the other hand, in the comparative examples, it was possible to control the nitriding potential within a range of 3.0 to 6.0.

However, in the comparative examples, in the case wherein the target nitriding potential was set to be lower than 1.5, in order to reduce the nitriding potential, the total introduction amount of the furnace introduction gases was excessively decreased such that an excessive negative pressure was generated in the furnace. Therefore, the inside of the furnace was replaced with a nitrogen gas and the surface hardening treatment was forcibly stopped (treatment 6 to treatment 10). In addition, in the comparative examples, in the case wherein the target nitriding potential was set to be 1.5, the error was very large.

In addition, in the case wherein the target nitriding potential was set to be 9.0, the amount of the ammonia gas in the exhaust gas exceeded the capability of the exhaust gas combustion decomposition apparatus 41 which combusts and decomposes the exhaust gas, and the operator complained of eye pain. Therefore, the inside of the furnace was replaced with a nitrogen gas and the surface hardening treatment was forcibly stopped (treatment 1).

Figure 8:
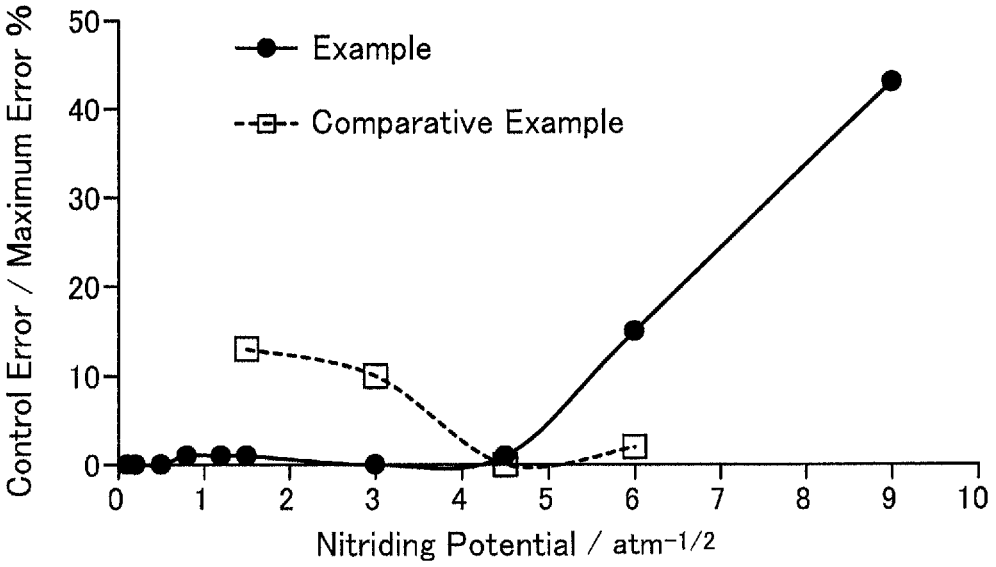
FIG. 8 is a graph for comparing controllable ranges of the nitriding potential at 500° C. (480° C. to 520° C.)).

From the controllable range (between 0.1 and 4.5) of the nitriding potential in the additional examples as shown in FIGS. 7 and 8 (500° C.) to the controllable range (between 0.1 and 1.3) of the nitriding potential in the original examples as shown in FIGS. 2 and 3 (580° C.), the upper limit of the controllable range is decreased depending on the rising of the temperature condition during the treatment.

DESCRIPTION OF REFERENCE SIGNS

1 Surface hardening treatment device
2 Processing furnace
3 Atmospheric gas concentration detector
4 Nitriding potential adjustor
5 Temperature adjustor
6 Recorder
8 Stirring fan
9 Stirring-fan drive motor
10 In-furnace temperature measuring device
11 Furnace body heater
13 In-furnace nitriding potential calculator
14 Gas introduction controller
15 Parameter setting device (touch panel)
16 On-off valve controller
17 On-off valve
20 Furnace introduction gas supplier
21 First furnace introduction gas supplier
22 First supply amount controller
23 First supply valve
24 First flow meter
25 Second furnace introduction gas supplier
26 Second supply amount controller
27 Second supply valve
28 Second flow meter
29 Furnace introduction gas pipe
30 Gas flow rate output adjustor
31 Programmable logic controller
40 Exhaust gas pipe
41 Exhaust gas combustion decomposition apparatus

What is claimed is:

1. A surface hardening treatment device for performing a gas nitriding treatment or a gas nitrocarburizing treatment as a surface hardening treatment for a work arranged in a processing furnace by introducing a plurality of furnace introduction gases into the processing furnace, the plurality of furnace introduction gases including only an ammonia gas, only an ammonia decomposition gas, or only an ammonia gas and an ammonia decomposition gas, as a gas that produces hydrogen in the processing furnace, the surface hardening treatment device comprising an in-furnace atmospheric gas concentration detector configured to detect a hydrogen concentration or an ammonia concentration in the processing furnace, an in-furnace nitriding potential calculator configured to calculate a nitriding potential in the processing furnace based on the hydrogen concentration or the ammonia concentration detected by the in-furnace atmospheric gas concentration detector, and a gas-introduction-amount controller configured to control an introduction amount of each of the plurality of furnace introduction gases by changing a flow rate ratio between the plurality of furnace introduction gases while keeping a total introduction amount of the plurality of furnace introduction gases constant, based on the nitriding potential in the processing furnace calculated by the in-furnace nitriding potential calculator and a target nitriding potential, such that the nitriding potential in the processing furnace is brought close to the target nitriding potential, wherein the target nitriding potential is set to be different values between time zones for the same work, but to be a constant value within each time zone, the gas-introduction-amount controller is configured to perform a PID control method in which the gas introduction amounts of the plurality of furnace introduction gases are input values, the nitriding potential in the processing furnace calculated by the in-furnace nitriding potential calculator is an output value, and the target nitriding potential is a target value, and a proportional gain in the PID control method, an integral gain or an integration time in the PID control method, and a differential gain or a differentiation time in the PID control method can be set for each different value of the target nitriding potential, from among candidate values that have been obtained in advance by performing pilot processes.

2. The surface hardening treatment device according to claim 1, wherein the target nitriding potential is set to be in a range of 0.05 to 1.3 for each time zone.

3. The surface hardening treatment device according to claim 2, wherein the target nitriding potential is set to be three or more different values between three or more time zones for the same work.

4. The surface hardening treatment device according to claim 1, wherein the target nitriding potential is set to be three or more different values between three or more time zones for the same work.

5. A surface hardening treatment method of performing a gas nitriding treatment or a gas nitrocarburizing treatment as a surface hardening treatment for a work arranged in a processing furnace by introducing a plurality of furnace introduction gases into the processing furnace, the plurality of furnace introduction gases including only an ammonia gas, only an ammonia decomposition gas, or only an ammonia gas and an ammonia decomposition gas, as a gas that produces hydrogen in the processing furnace, the surface hardening treatment device comprising an in-furnace atmospheric gas concentration detecting step of detecting a hydrogen concentration or an ammonia concentration in the processing furnace, an in-furnace nitriding potential calculating step of calculating a nitriding potential in the processing furnace based on the hydrogen concentration or the ammonia concentration detected at the in-furnace atmospheric gas concentration detecting step, and a gas-introduction-amount controlling step of controlling an introduction amount of each of the plurality of furnace introduction gases by changing a flow rate ratio between the plurality of furnace introduction gases while keeping a total introduction amount of the plurality of furnace introduction gases constant, based on the nitriding potential in the processing furnace calculated at the in-furnace nitriding potential calculating step and a target nitriding potential, such that the nitriding potential in the processing furnace is brought close to the target nitriding potential, wherein the target nitriding potential is set to be different values between time zones for the same work, but to be a constant value within each time zone, at the gas-introduction-amount controlling step, a PID control method is performed in which the gas introduction amounts of the plurality of furnace introduction gases are input values, the nitriding potential in the processing furnace calculated at the in-furnace nitriding potential calculating step is an output value, and the target nitriding potential is a target value, and a proportional gain in the PID control method, an integral gain or an integration time in the PID control method, and a differential gain or a differentiation time in the PID control method are set for each different value of the target nitriding potential, from among candidate values that have been obtained in advance by performing pilot processes.

6. The surface hardening treatment method according to claim 5, wherein the target nitriding potential is set to be in a range of 0.05 to 1.3 for each time zone.

7. The surface hardening treatment method according to claim 5, wherein the target nitriding potential is set to be three or more different values between three or more time zones for the same work.

8. The surface hardening treatment method according to claim 6, wherein the target nitriding potential is set to be three or more different values between three or more time zones for the same work.

* * * * *